US005789711A

United States Patent [19]

Gaeris et al.

[11] Patent Number: 5,789,711

[45] Date of Patent: Aug. 4, 1998

[54] HIGH-PERFORMANCE DATA CABLE

[75] Inventors: Galen Mark Gaeris, Richmond, Ind.; Paul Z. Vanderlaan, Oxford, Ohio

[73] Assignee: Belden Wire & Cable Company, Richmond, Ind.

[21] Appl. No.: 629,509

[22] Filed: Apr. 9, 1996

[51] Int. Cl.[6] ..... H01B 11/02

[52] U.S. Cl. ..... 174/113 C; 174/131 A

[58] Field of Search ..... 174/28, 29, 36, 174/113 R, 113 C, 113 AS, 131 A, 34

[56] References Cited

U.S. PATENT DOCUMENTS

| | | | |
|---|---|---|---|
| 483,285 | 9/1892 | Guilleaume | 174/113 R |
| 1,977,209 | 10/1934 | Sargent | 173/264 X |
| 2,204,737 | 6/1940 | Swallow et al. | 174/28 |
| 3,588,313 | 6/1971 | Delves-Broughton | 174/28 |
| 3,603,715 | 9/1971 | Vinnhorst et al. | 174/15 X |
| 3,621,118 | 11/1971 | Bunish et al. | 174/115 X |
| 3,927,247 | 12/1975 | Timmons | 174/36 |
| 4,038,489 | 7/1977 | Stenson et al. | 174/70 R |
| 4,374,881 | 2/1983 | Hamilton | 428/36 |
| 4,683,349 | 7/1987 | Takebe | 174/69 X |
| 4,729,409 | 3/1988 | Paul | 138/115 |
| 4,778,246 | 10/1988 | Carroll | 350/96.23 |
| 5,132,488 | 7/1992 | Tessier et al. | 174/34 |
| 5,305,797 | 4/1994 | Roy, Sr. | 138/108 |
| 5,574,250 | 11/1996 | Hardie et al. | 174/36 |

FOREIGN PATENT DOCUMENTS

| | | | |
|---|---|---|---|
| 2459844 | 7/1976 | Germany | 174/113 C |
| 5-101711 | 4/1993 | Japan | 174/113 C |
| 1343447 | 10/1987 | U.S.S.R. | 174/113 C |

*Primary Examiner*—Kristine L. Kincaid
*Assistant Examiner*—Chau N. Nguyen
*Attorney, Agent, or Firm*—Laff, Whitesel, Conte & Saret, Ltd.; Robert F. I. Conte

[57] ABSTRACT

The present invention is for a high performance data cable which has an interior support or star separator. The star separator or interior support extends along the longitudinal length of the data cable. The star separator or interior support has a central region. A plurality of prongs or splines extend outward from the central region along the length of the central region. Each prong or spline is adjacent with at least two other prongs or splines. The prongs or splines may be helixed or S-Z shaped as they extend along the length of the star separator or interior support. Each pair of adjacent prongs or splines defines grooves which extend along the longitudinal length of the interior support. At least two of the grooves have disposed therein an insulated conductor.

3 Claims, 2 Drawing Sheets

HIGH-PERFORMANCE DATA CABLE

FIELD OF INVENTION

This invention relates to a high performance data cable utilizing twisted pairs. The data cable has an interior support or star separator around which the twisted pairs are disposed.

BACKGROUND OF THE INVENTION

Many data communication systems utilize high performance data cables having at least four twisted pairs. Typically, two of the twisted pairs transmit data and two of the pairs receive data. A twisted pair is a pair of conductors twisted about each other. A transmitting twisted pair and a receiving twisted pair often form a subgroup in a cable having four twisted pairs.

A high performance data cable utilizing twisted pair technology must meet exacting specifications with regard to data speed and electrical characteristics. The electrical characteristics include such things as controlled impedance, controlled near-end cross-talk (NEXT), controlled ACR (attenuation minus cross-talk) and controlled shield transfer impedance.

One way twisted pair data cables have tried to meet the electrical characteristics, such as controlled NEXT, is by utilizing individually shielded twisted pairs (ISTP). These shields insulate each pair from NEXT. Data cables have also used very complex lay techniques to cancel E and B fields to control NEXT. Finally, previous data cables have tried to meet ACR requirements by utilizing very low dielectric constant insulations. The use of the above techniques to control electrical characteristics has problems.

Individual shielding is costly and complex to process. Individual shielding is highly susceptible to geometric instability during processing and use. In addition, the ground plane of individual shields, 360° in ISTP's, lessens electrical stability.

Lay techniques are also complex, costly and susceptible to instability during processing and use.

Another problem with many data cables is their susceptibility to deformation during manufacture and use. Deformation of the cable's geometry, such as the shield, lessens electrical stability. Applicant's unique and novel high performance data cable meets the exacting specifications required of a high performance data cable while addressing the above problems.

This novel cable has an interior support with grooves. Each groove accommodates at least one twisted pair. The interior support provides needed structural stability during manufacture and use. The grooves also improve NEXT control by allowing for the easy spacing of the twisted pairs. The easy spacing lessens the need for complex and hard to control lay procedures and individual shielding.

The interior support allows for a single overall shield having a much smaller ground plane than individual shields. The smaller ground plane improves electrical stability. For instance, the overall shield improves shield transfer impedance. The overall shield is also lighter, cheaper and easier to terminate than ISTP designs.

This novel cable produces many other significant advantageous results such as:

- improved impedance determination because of the ability to precisely place twisted pairs;
- the ability to meet a positive ACR value from twisted pair to twisted pair with a cable that is no larger than an ISTP cable; and
- an interior support which allows for a variety of twisted pair dimensions.

Previous cables have used supports designed for coaxial cables. The supports in these cables are designed to place the center conductor coaxially within the outer conductor. This cable has numerous advantageous features over coaxial designs.

The novel interior support provides grooves which precisely place twisted pairs with relative ease. The precise placement controls NEXT between pairs. The supports of the coaxial designs, however, are not directed towards accommodating twisted pairs. The slots in the coaxial support remain free of any conductor. The slots in the coaxial support are merely a side effect of the design's direction to center a conductor within an outer conductor with a minimal material cross section to reduce costs. In fact, one would really not even consider these coaxial cable supports in concurrence with twisted pair technology.

Some cables have used supports in connection with twisted pairs. These cables, however, suggest using a standard "X", or "+" shaped support, hereinafter both referred to as the "X" support. The standard "X" support is completely different than this support.

Protrusions extend from the standard "X" support. These protrusions have substantially parallel sides.

The prongs or splines in this invention provide a superior crush resistance to the protrusions of the standard "X" support. The superior crush resistance better preserves the geometry of the pairs relative to each other and of the pairs relative to the other parts of the cables such as the shield. In addition, the prongs or splines in this invention preferably have a pointed or slightly rounded apex top which easily accommodates an overall shield.

SUMMARY OF THE INVENTION

In one embodiment, we provide a data cable which has a one piece plastic interior support. The interior support extends along the longitudinal length of the data cable. The interior support has a central region which extends along the longitudinal length of the interior support. The interior support has a plurality of prongs. Each prong is integral with the central region. The prongs extend along the longitudinal length of the central region and extend outward from the central region. The prongs are arranged so that each prong of said plurality is adjacent with at least two other prongs.

Each pair of adjacent prongs define a groove extending along the longitudinal length of the interior support. The prongs have a first and second lateral side. A portion of the first lateral side and a portion of the second lateral side of at least one prong converge towards each other.

The cable further has a plurality of insulated conductors disposed in at least two of the grooves.

A cable covering surrounds the interior support. The cable covering is exterior to the conductors. Applicants' inventive cable can be alternatively described as set forth below.

The cable has an interior support extending along the longitudinal length of the data cable. The interior support has a central region extending along the longitudinal length of the interior support. The interior support has a plurality of prongs. Each prong is integral with the central region. The prongs extend along the longitudinal length of the central region and extend outward from the central region. The prongs are arranged so that each prong is adjacent with at least two other prongs.

Each prong has a base. Each base is integral with the central region. At least one of said prongs has a base which has a horizontal width greater than the horizontal width of a portion of said prong above said base. Each pair of the adjacent prongs defines a groove extending along the longitudinal length of the interior support.

A plurality of conductors is disposed in at least two of said grooves.

A cable covering surrounds the interior support. The cable covering is exterior to the conductors. The invention can further be alternatively described by the following description.

An interior support for use in a high-performance data cable. The data cable has a diameter of from about 0.300" to about 0.400". The data cable has a plurality of insulated conductor pairs.

The interior support in said high-performance data cable has a cylindrical longitudinally extending central portion. A plurality of splines radially extend from the central portion. The splines also extend along the length of the central portion. The splines have a triangular cross-section with the base of the triangle forming part of the central portion, each triangular spline has the same radius. Adjacent splines are separated from each other to provide a cable chamber for at least one pair of conductors. The splines extend longitudinally in a helical, S, or Z-shaped manner.

Accordingly, the present invention desires to provide a data cable that meets the exacting specifications of high performance data cables, has a superior resistance to deformation during manufacturing and use, allows for control of near-end cross talk, controls electrical instability due to shielding, and can be a 300 MHz cable with a positive ACR ratio.

It is still another desire of the invention to provide a cable that does not require individual shielding, and that allows for the precise spacing of conductors such as twisted pairs with relative ease.

It is still a further desire of the invention to provide a data cable that has an interior support that accommodates a variety of AWG's and impedances, improves crush resistance, controls NEXT, controls electrical instability due to shielding, increases breaking strength, and allows the conductors such as twisted pairs to be spaced in a manner to achieve positive ACR ratios.

Other desires, results, and novel features of the present invention will become more apparent from the following drawing and detailed description and the accompanying claims.

DETAILED DESCRIPTION

The following description will further help to explain the inventive features of this cable.

Figure 1:
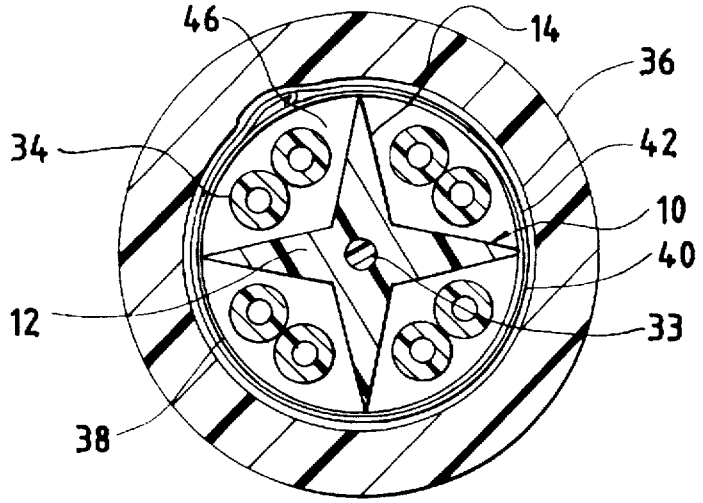
FIG. 1 is a cross-sectional view taken along the horizontal plane of one embodiment of this invention.
Figure 2:
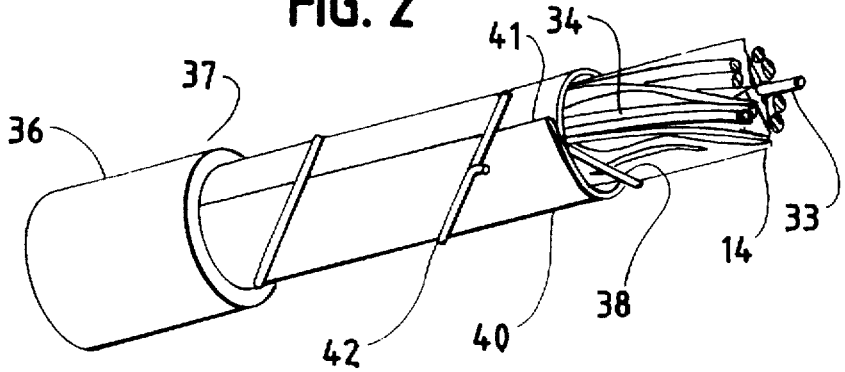
FIG. 2 is a top right perspective view of this invention. The view shows the cable cut away to expose its various elements. The view further shows the helical twist of the prongs or splines.

FIG. 1 is a cross-section taken along the horizontal plane of one embodiment of this novel cable. The shown embodiment has an interior support or star separator (10). The interior support or star separator runs along the longitudinal length of the cable as can be seen in FIG. 2. The interior support or star separator, hereinafter, in the detailed description, both referred to as the "star separator", has a central region (12) extending along the longitudinal length of the star separator. The star separator has four prongs or splines. Each prong or spline (14), hereinafter in the detailed description both referred to as splines, extends outward from the central region and extends along the longitudinal length of the central region. The splines are integral with the central region. Each spline has a base portion (15). Each base portion is integral with the central region. Each spline has a base portion which has a horizontal width greater than the horizontal width of a portion of said spline above said base.

Each spline also has a first lateral side (16) and a second lateral side (17). The first and second lateral sides of each spline extend outward from the central region and converge towards each other to form a top portion (18). Each spline has a triangular cross section with preferably an isosceles triangle cross section. Each spline is adjacent with at least two other splines. For instance, spline (14) is adjacent to both adjacent spline (20) and adjacent spline (21).

The first lateral side of each spline is adjacent with a first or a second lateral side of another adjacent spline. The second lateral side of each spline is adjacent to the first or second side of still another adjacent spline.

Figure 3:
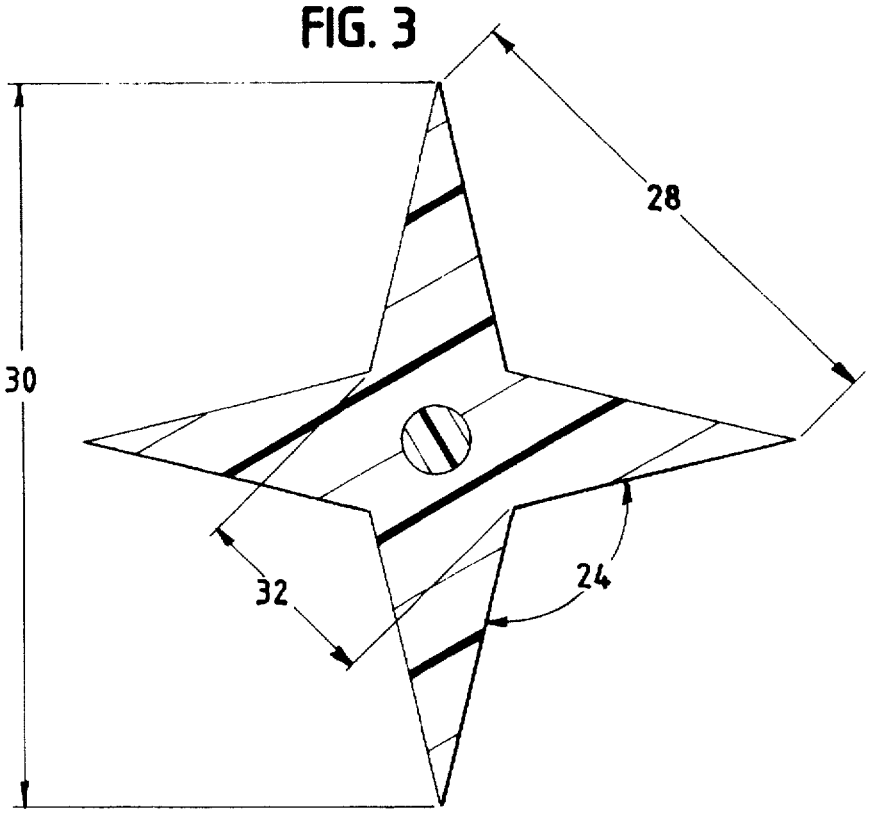
FIG. 3 is a cross-section of the interior support or star separator taken along the horizontal plane showing some of the dimensions of the interior support or star separator.
Figure 4:
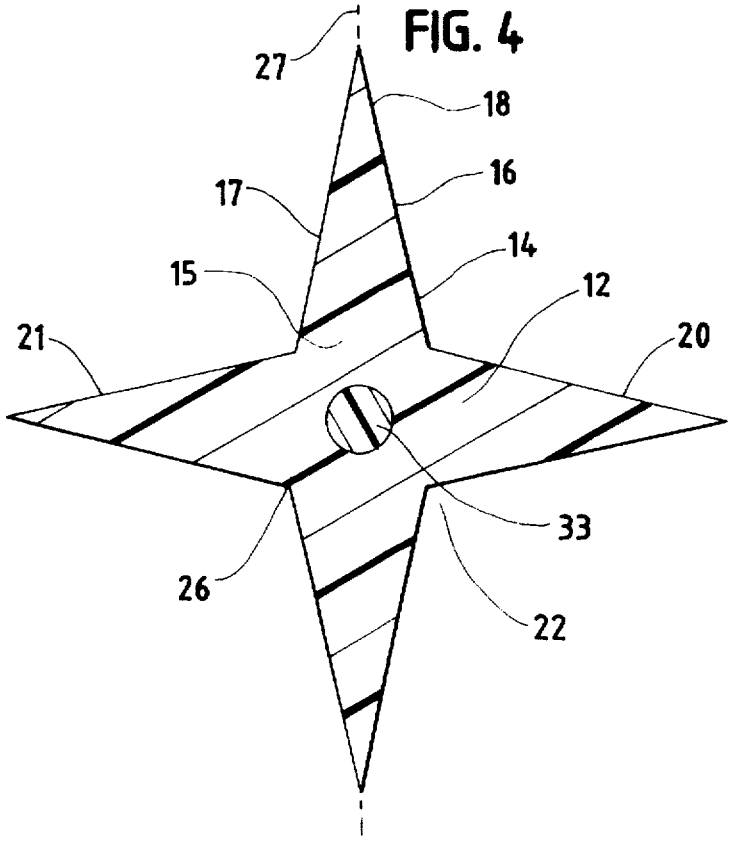
FIG. 4 is a horizontal cross section of the interior or star separator support showing the features of the prongs or splines.

Each pair of adjacent splines defines a groove (22). The angle (24) of each groove is greater than 90°. The adjacent sides are angled towards each other so that they join to form a crevice (26). The groove extends along the longitudinal length of the star separator. The splines are arranged around the central region so that a substantial congruency exists along a straight line (27) drawn through the center of the horizontal cross section of the star separator. Further, the splines are spaced so that each pair of adjacent splines has a distance (28), measured from the center of the top of one spline to the center of the top of an adjacent spline (top to top distance) as shown in FIG. 3. The top to top distance (28) being substantially the same for each pair of adjacent splines.

In addition, the shown embodiment has a preferred "tip to crevice" ratio of between about 2.1 and 2.7. Referring to FIG. 3. The "tip distance" (30) is the distance between two top portions opposite each other. The "crevice distance" (32) is the distance between two crevices opposite each other. The ratio is measured by dividing the "tip" distance by the "crevice" distance.

The specific "tip distance", "crevice distance" and "top to top" distances can be varied to fit the requirements of the user such as various AWG's and impedances. The specific material for the star separator also depends on the needs of the user such as crush resistance, breaking strengths, the need to use gel fillings, the need for safety, and the need for flame and smoke resistance. One may select a suitable copolymer. The star separator is solid beneath its surface.

A strength member may be added to the cable. The strength member (33) in the shown embodiment is located in the central region of the star separator. The strength member runs the longitudinal length of the star separator. The strength member is a solid polyethylene or other suitable plastic, textile (nylon, aramid, etc.), fiberglass (FGE rod), or metallic material.

Conductors, such as the shown insulated twisted pairs, (34) are disposed in each groove. The pairs run the longitudinal length of the star separator. The twisted pairs are insulated with a suitable copolymer. The conductors are those normally used for data transmission. The twisted pairs may be Belden's DataTwist® 350 twisted pairs. Although the embodiment utilizes twisted pairs, one could utilize various types of insulated conductors with the star separator.

The star separator may be cabled with a helixed or S-Z configuration. In a helical shape, the splines extend helically along the length of the star separator as shown in FIG. 2. The helically twisted splines in turn define helically twisted conductor receiving grooves which accommodate the twisted pairs.

The cable (37) as shown in FIG. 2 is a high performance shielded 300 Mhz data cable. The cable has an outer jacket (36) the outer jacket can be polyvinyl chloride or neoprene.

Over the star separator is a polymer binder sheet (38). The binder is wrapped around the star separator to enclose the twisted pairs. The binder has an adhesive on the outer surface to hold a laterally wrapped shield (40). The shield (40) is a tape with a foil or metal surface facing towards the interior of the jacket. The shield in the shown embodiment is of foil and has an overbelt (shield is forced into round smooth shape) (41) which may be utilized for extremely well controlled electricals. A metal drain wire (42) is spirally wrapped around the shield. The drain spiral runs the length of the cable. The drain functions as a ground.

My use of the term "cable covering" refers to a means to insulate and protect my cable. The cable covering being exterior to said star member and insulated conductors disposed in said grooves. The outer jacket, shield, drain spiral and binder described in the shown embodiment provide an example of an acceptable cable covering. The cable covering, however, may simply include an outer jacket.

The cable may also include a gel filler to fill the void space (46) between the interior support, twisted pairs and a part of the cable covering.

The splines of applicants' novel cable allow for precise support and placement of the twisted pairs. The star separator will accommodate twisted pairs of varying AWG's and impedance. The unique triangular shape of the splines provides a geometry which does not easily crush.

The crush resistance of applicants' star separator helps preserve the spacing of the twisted pairs, and control twisted pair geometry relative to other cable components. Further, adding a helical or S-Z twist improves flexibility while preserving geometry.

The use of a single shield around the star separator allows a minimum ground plane surface over the twisted pairs, about 45° of covering. The improved ground plane provided by applicants' shield, allows applicants' cable to meet a very low transfer impedance specification. The overall shield may have a more focused design for ingress and egress of cable emissions and not have to focus on NEXT duties.

The strength member located in the central region of the star separator allows for the placement of stress loads away from the pairs.

It will, of course, be appreciated that the embodiment which has just been described has been given by way of illustration, and the invention is not limited to the precise embodiments described herein; various changes and modifications may be effected by one skilled in the art without departing from the scope or spirit of the invention as defined in the appended claims.

We claim:

1. In a high performance data cable having a diameter of from about 0.300" to about 0.400", a plurality of insulated conductor pairs, and an interior support, said interior support comprising:

a cylindrical longitudinally extending central portion;

a plurality of splines radially extending from said central portion along the length of said central portion, said splines having a triangular cross-section with the base of the triangle forming part of the central portion, each of said triangular splines having the same radius;

each spline of said plurality of splines being adjacent to two other splines of said plurality of splines;

said splines longitudinally extending in a helical or S-Z shaped manner;

a shield having a lateral fold, said shield supported by said triangular splines, said shield and splines defining a plurality of at least four conductor compartments;

a twisted pair conductor disposed in each of said compartments; and said splines have a tip-to-crevice ration from about 2.1 to about 2.8.

2. A high performance data cable comprising:

an interior support extending along a longitudinal length of the data cable, said interior support having a central region, said central region extending along a longitudinal length of said interior support;

a plurality of prongs, each of said prongs being integral with said central region, said prongs extending along a longitudinal length of the central region and extending outward from said central region;

an arrangement of said plurality of prongs wherein each of said prongs is adjacent with at least two other of said prongs, said arrangement forming a plurality of pairs of adjacent prongs;

a groove defined by each of said pairs of adjacent prongs, said groove extends along the longitudinal length of the interior support, said plurality of pairs of adjacent prongs defining a plurality of said grooves;

in said plurality of prongs, each of said prongs having a first and second lateral side, a portion of said first lateral side and a portion of said second lateral side of at least one of said prongs converging towards each other;

a plurality of conductor compartments, each of said conductor compartments defined by a pair of said plurality of pairs of adjacent prongs and a foil shield having a lateral fold;

a twisted pair of insulated conductors in each of said conductor compartments; and said prongs have a tip-to-crevice ratio of about 2.1 to about 2.8.

3. A high performance data cable comprising:

an interior support extending along a longitudinal length of the data cable, said interior support having a central region, said central region extending along a longitudinal length of said interior support;

a plurality of prongs, each of said prongs being integral with said central region, said prongs extending along a longitudinal length of the central region and extending outward from said central region;

an arrangement of said plurality of prongs wherein each of said prongs is adjacent with at least two other prongs, said arrangement forming a plurality of pairs of adjacent prongs;

a groove defined by each of said Pairs of adjacent prongs, said groove extends along the longitudinal length of the interior support, said plurality of pairs of adjacent prongs defining a plurality of said grooves;

a plurality of conductor compartments, each of said conductor compartments defined by a pair of said plurality of pairs of adjacent prongs and a foil shield having a lateral fold;

a twisted pair of insulated conductors in each of said conductor compartments; and said prongs have a tip-to-crevice ratio of about 2.1 to about 2.8.

* * * * *

UNITED STATES PATENT AND TRADEMARK OFFICE

CERTIFICATE OF CORRECTION

PATENT NO. : 5,789,711
DATED : Aug. 4, 1998
INVENTOR(S) : Galen M. Gareis, et al It is certified that error appears in the above-indentified patent and that said Letters Patent is hereby corrected as shown below:

On the title page,
Below "United States Patent", --Gareis et al.--

[75] Delete "Gaeris" and insert --Gareis--

Signed and Sealed this

Twenty-second Day of June, 1999

*Attest:*

Q. TODD DICKINSON

*Attesting Officer*

*Acting Commissioner of Patents and Trademarks*